United States Patent [19]

Hampton et al.

[11] Patent Number: 4,675,641

[45] Date of Patent: Jun. 23, 1987

[54] RATING PLUG FOR MOLDED CASE CIRCUIT BREAKERS

[75] Inventors: Thomas G. Hampton, Hartford; James M. Mitsch, West Hartford; Joseph M. Palmieri, Southington; David S. Parker, South Windsor; James I. Smith, Avon, all of Conn.

[73] Assignee: General Electric Company, New York, N.Y.

[21] Appl. No.: 876,499

[22] Filed: Jun. 20, 1986

[51] Int. Cl.[4] ..... H01H 71/16; H01H 75/10

[52] U.S. Cl. ..... 337/82; 335/39; 335/45; 337/70

[58] Field of Search ..... 335/39, 40, 45; 337/70, 337/82, 56, 57

[56] References Cited

U.S. PATENT DOCUMENTS

| | | | |
|---|---|---|---|
| 2,831,935 | 4/1958 | Page | 337/70 |
| 2,839,633 | 6/1958 | Moyer | 337/57 |
| 4,570,144 | 2/1986 | Bridges et al. | 337/88 |

*Primary Examiner*—Harold Broome

*Attorney, Agent, or Firm*—Richard A. Menelly; Walter C. Bernkopf; Fred Jacob

[57] ABSTRACT

A selectable rating plug allows a standard molded case circuit breaker design to be used over a wide range of ampere ratings. The rating plug is used to control the thermal load on the thermally responsive trip element within the breaker. Movement of the thermally responsive element articulates the breaker trip mechanism in response to predetermined overload conditions to interrupt circuit current.

22 Claims, 11 Drawing Figures

RATING PLUG FOR MOLDED CASE CIRCUIT BREAKERS

BACKGROUND OF THE INVENTION

U.S. patent application Ser. No. 718,409, filed Apr. 1, 1985, entitled "Circuit Breaker Assembly For High Speed Manufacture" describes a circuit breaker manufactured, in part, by automated processing equipment. The breaker operating mechanism allows a uniform breaker design to be operative over a wide range of breaker ampere ratings. A removable trip unit assembly facilitates the insertion of selected trip elements for breakers having progressively higher ampere ratings. It has since been determined, that a single thermal element design can be used for various ampere ratings by controlling the thermal response of the thermal element by means of rating plugs having predetermined thermal load characteristics.

One example of an earlier rating plug design is found within U.S. Pat. No. 2,831,935 in the name of Robert G. Paige, which describes a combination circuit breaker and motor starter device that changes the ampere rating of the device by changing the size of the resistance heater used to replicate the electrical current flow through the protected circuit. The thermally responsive trip element responds to the predetermined temperature values set by each of the resistance values. This arrangement allows a single circuit breaker design to operate over a range of breaker ampere ratings by proper selection of the resistance values.

An additional circuit breaker design having variable ampere ratings is found within U.S. Pat. No. 2,839,633, which issued to David F. Moyer. This patent discloses the use of a rating plug in the form of a spring-loaded heat absorbing mass. The thermal input to the circuit breaker bimetal trip element is varied by increasing or decreasing the size of the heat absorbing mass.

U.S. Pat. No. 4,570,144, which issued to Robert B. Bridges et al., describes a thermally actuated variable-rating circuit breaker including an adjustable heat sink element to effectively vary the ampere rating of the breaker.

The instant invention proposes a selectable rating plug for setting the ampere ratings of a molded case circuit breaker by the arrangement of materials of predetermined thermal diffusivities in thermal relation with the thermally responsive trip element in correspondence with the tripping requirements for each ampere rating.

SUMMARY OF THE INVENTION

A molded case circuit breaker having a single operating mechanism design and a single thermally responsive element is employed over a wide range of ampere ratings by means of selectable rating plugs having predetermined thermal diffusivities. The thermal diffusivity and electrical resistivity of the rating plug sets the response time for the thermal trip element for preselected overcurrent values.

DESCRIPTION OF THE PREFERRED EMBODIMENT

Figure 1:
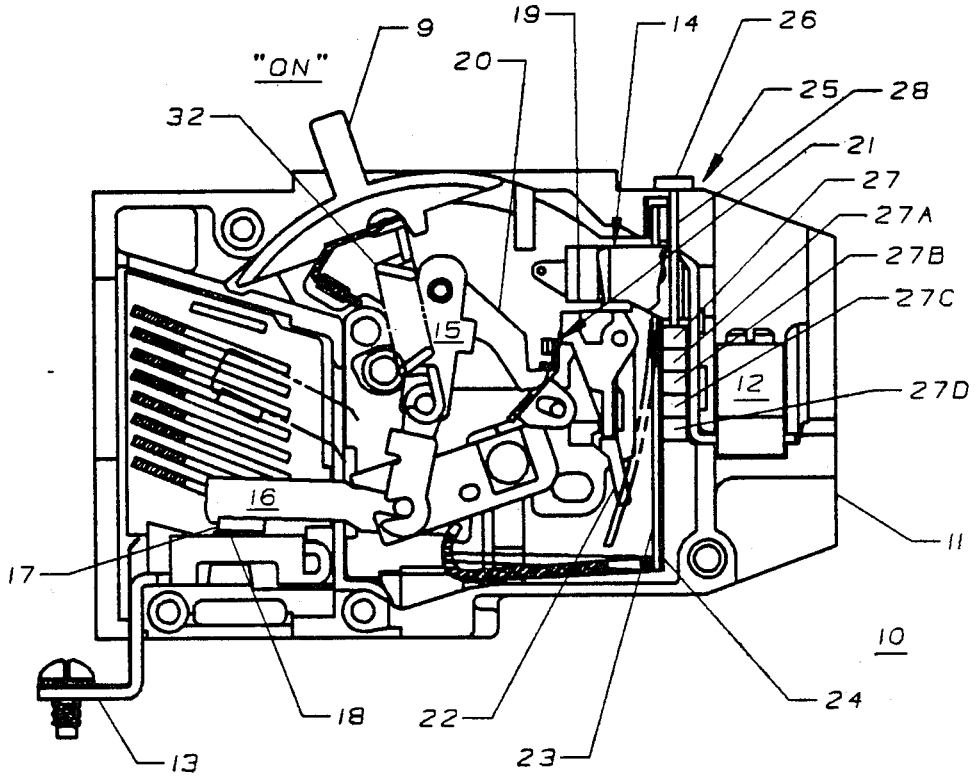
FIG. 1 is a side view of an industrial rated molded case circuit breaker employing a rating plug according to the invention.

An industrial rated molded case circuit breaker 10 is depicted in FIG. 1 and consists of a case 11 to which external electrical connection is made by means of a load terminal strap 12 and a line terminal strap 13. The circuit current is sensed within a trip unit generally indicated at 14, which includes an electromagnet 19 for determining short circuit conditions and a thermally responsive trip element 23 for determining both long and short time-over-current conditions. An operating mechanism 15 holds a movable contact arm 16 which carries the movable contact 17 at one end in electrical connection with a stationary or fixed contact 18 against the opening bias provided by a pair of powerful operating springs 32 arranged on opposite sides of the cradle 20. A latch arrangement 21 in combination with the cradle holds the operating mechanism 15 in the closed condition with the operating handle 9 indicated as "on". A trip bar 22 connecting with the the latch 21 is displaced by operation of the thermal element 23, as indicated in phantom, causing the latch to release the cradle and allow the movable contact arm 16 to move to the open position, also indicated in phantom. To set the ampere rating of the circuit breaker 10, a rating plug 25 is inserted between the load terminal strap 12 and a heater element 24. The rating plug is positioned along the heater by selection of a rod 28 and a cap 26, which effectively sets the position of a conductive block 27 affixed to the end of the rod. The circuit current transfers from the load terminal strap through the conductive block and thence through the heater. A plurality of discrete rating plugs having effective conductive blocks 27A–27D are shown progressively arranged along the heater. The entire heater is transversed by circuit current through a rating plug containing the conductive block 27, while substantially lesser portions of the heater are transversed by conduction through the successive conductive blocks 27A–27D. The heater temperature increases with the length traversed by the circuit current such that the time to reach a predetermined temperature increases with the progression of blocks from 27A–27D.

Figure 2:
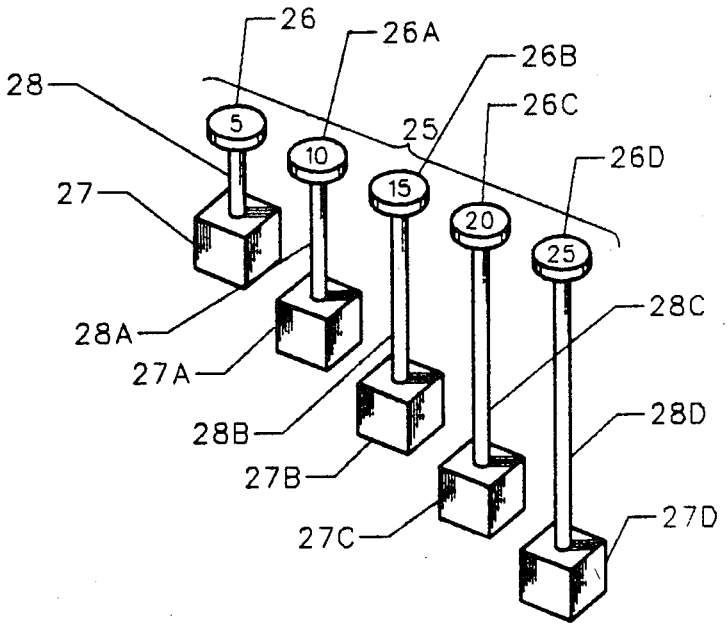
FIG. 2 is a top perspective view of a plurality of discrete rating plugs used within the circuit breaker depicted in FIG. 1.
Figure 6:
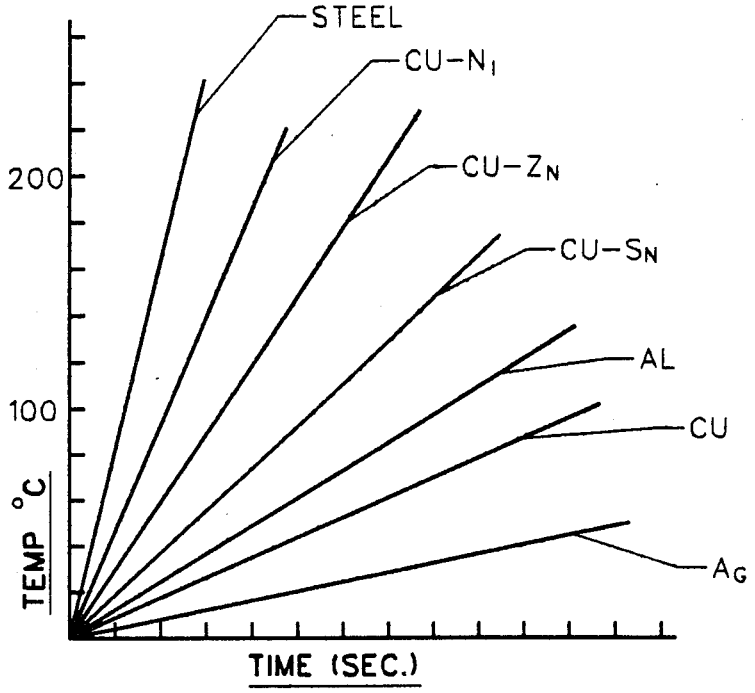
FIG. 6 is a graphic representation of the temperature gradient of various rating plug compositions as a function of time.

The configuration of the rating plugs 25 is shown in FIG. 2 with the ampere rating indicia printed on the cap 26 and with varying lengths of the rods from 28–28D to effectively set the distance of the respective conductive blocks 27–27D along the heater. The effective ampere rating of the rating plugs 25, in FIG. 2, increases from 5 amps to 25 amps, for example, as indicated from 26–26D as the length of distance through the heater transversed by the circuit current decreases in proportion to the length of rods 28–28D. Besides setting the effective resistance through which the circuit current must traverse to generate heat within the heater 23, the rating plug can also be selective to effect the quantity of heat delivered to the thermal element 23 by carefully selecting both the electrical and thermal conductive properties of the respective conductive blocks. The time taken to reach a predetermined temperature for various metal blocks is depicted in FIG. 6 to show the different time requirements for a conductive block such as 27 having a uniform geometry and consisting of the different metals. Steel, which basically contains iron, for example, having the poorest thermal and electrical conductivity, generates heat at a faster rate than aluminum and copper and silver, as indicated. To further increase or decrease the response time for the heater 24 to generate sufficient heat to activate the thermal element 23, the metal comprising the respective conductive blocks 27–27D can be selected accordingly along with the selected rod length.

Figure 3:
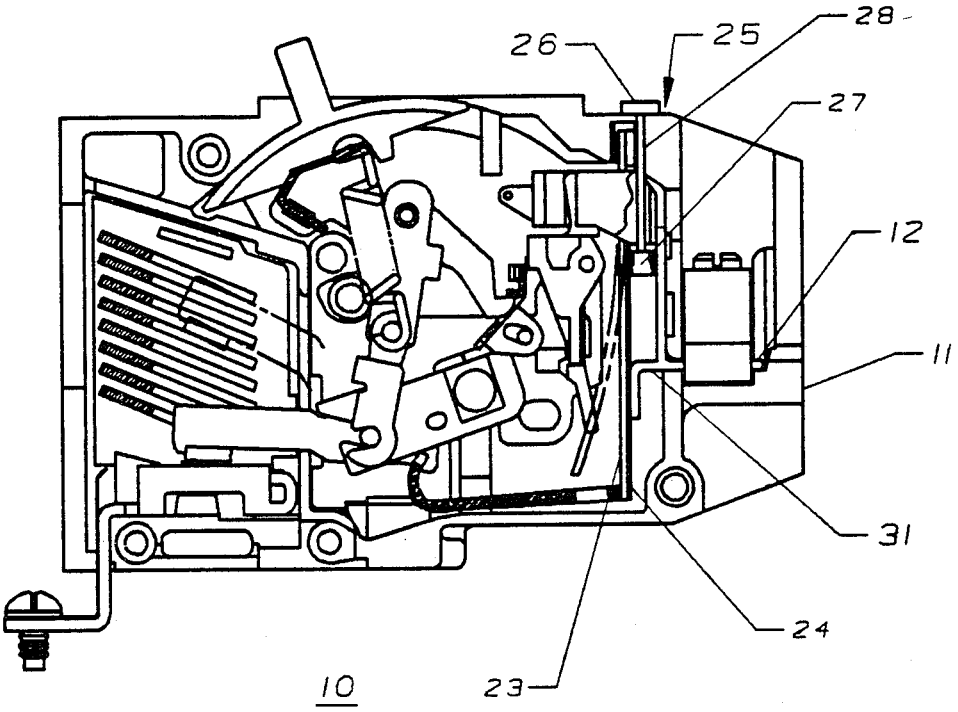
FIG. 3 is a side view of an industrial rated molded case circuit breaker using an alternate embodiment of the rating plug depicted in FIGS. 1 and 2.

To compensate for any contact resistance that may occur between the conductive block and the interface between the load terminal and the heater 24, the rating plug 25 having the configuration within the circuit breaker 10 shown in FIG. 3 is employed. In this arrangement, a bridging conductor 31 provides the main conductive path for the circuit current, while a parallel path is provided to the rating plug 25 via a conductive block such as 27. The bridging conductor 31 provides a fixed quantity of heat for any given current by transfer through the bottom of the heater 23 while the additive heat provided through the rating plug sets the thermal response of the thermal element in a manner similar to that described earlier with reference to FIGS. 1 and 2.

Figure 5:
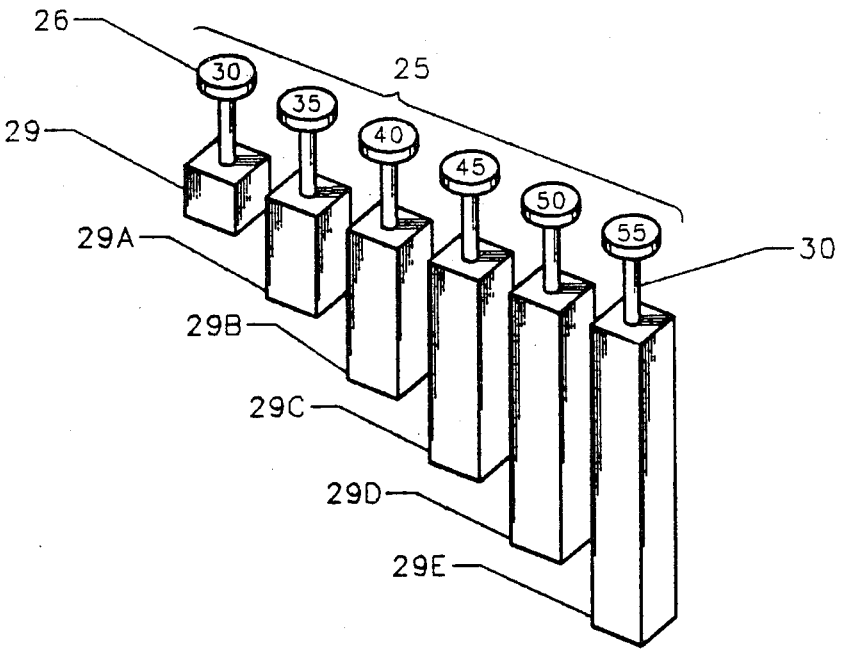
FIG. 5 is a top perspective view of a plurality of discrete rating plugs used within the circuit breaker depicted in FIG. 4.
Figure 4:
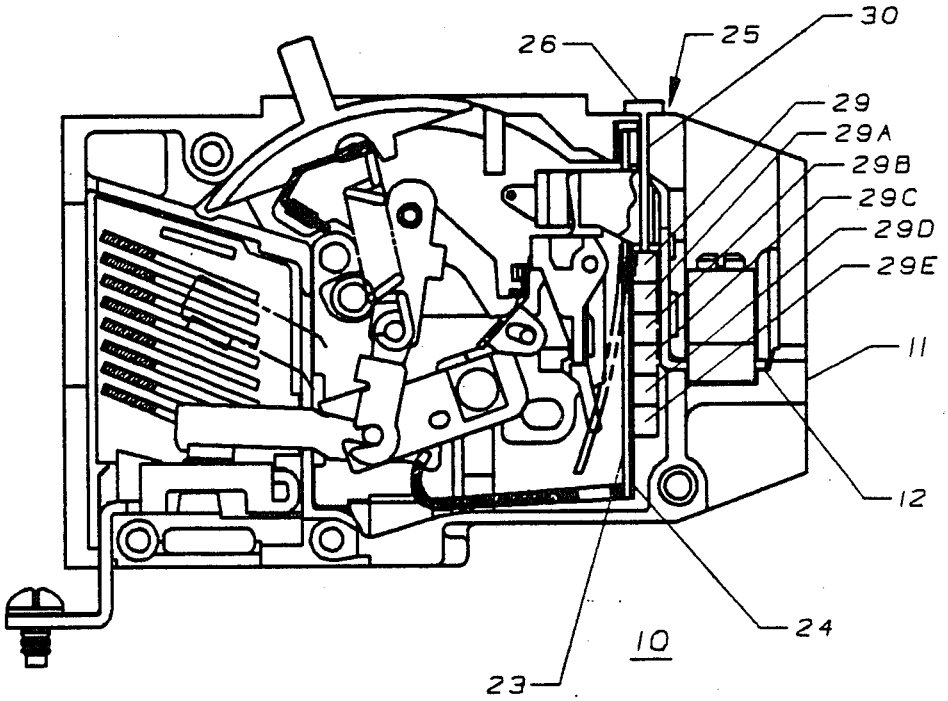
FIG. 4 is a side view of an industrial rated molded case circuit breaker utilizing a further embodiment of the rating plug depicted in FIGS. 1 and 2.

FIG. 4 contains an industrial rated molded case circuit breaker 10 similar to that depicted in FIG. 1 and consisting of a case 11 with a load terminal 12 interconnected with a heater 24 by means of a rating plug 25. The rating plug for this circuit breaker is depicted in FIG. 5 and similarly comprises a cap 26 and a rod 30. The length of the rod 30 is constant, however, while the length and mass of the conductive blocks increase from 29–29E. Referring back to FIG. 4, it is noted that less of the heater 24 is transversed by the circuit current as the conductive blocks increase from 29 to 29E and that the effective thermal mass of the rating plug also increases. The time for the thermal element 23 to reach its actuating temperature with conductive block 29 would therefore be substantially shorter than that required with conductive block 29E.

Figure 7:
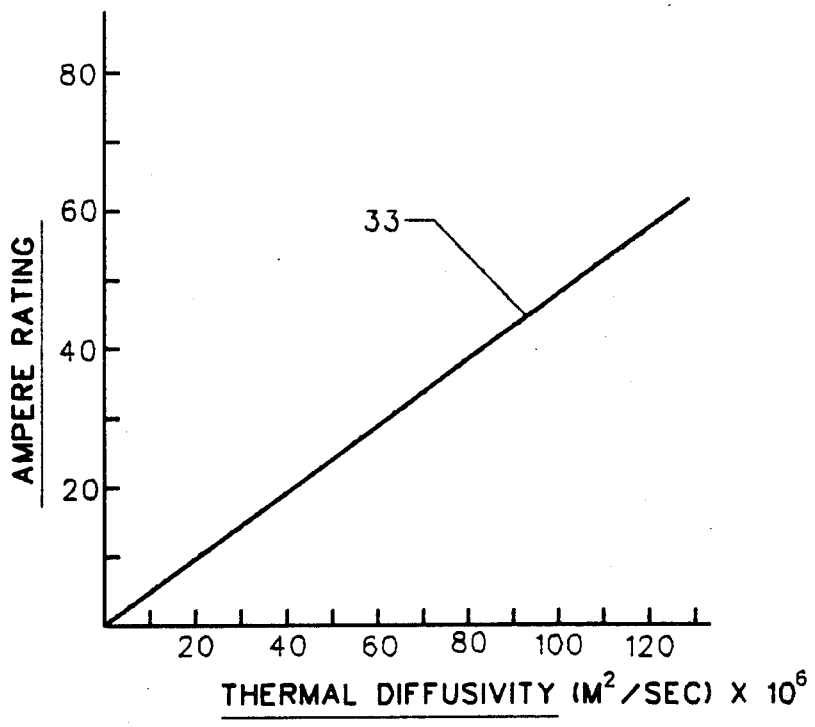
FIG. 7 is a graphic representation of the relationship between the circuit breaker ampere rating and the thermal diffusivity of the various rating plug compositions of FIG. 6.

The thermal diffusivity and electrical resistivity values of the conductive blocks used within the rating plugs depicted in FIGS. 2 and 5 is shown in the following table. The thermal diffusivity value for each of the listed compositions is obtained by dividing the thermal conductivity of the material selected by the product of the material density and the specific heat of the material. The relationship between the circuit breaker ampere rating and the thermal diffusivity is shown at 33 in FIG. 7. Depending upon such factors as size and economics, the particular material and mass can be selected to effectively produce the desired thermal diffusivity to the rating plug to set the specific ampere rating. The ampere rating can be further increased for any given material by increasing the thermal mass of the material. It is noted that metals having the highest electrical resistivity, which increase the heat generated within the heater, also exhibit the lowest thermal diffusivity, which favors retaining the heat within the heater.

TABLE I

| MATERIAL | THERMAL DIFFUSIVITY $M^2/SEC \times 10^6$ | ELECTRICAL RESISTIVITY MICRO-OHMS-CM |
|---|---|---|
| Type 316 Stainless Steel | 4 | 72 |
| 53Cu—45Ni | 6 | 23 |
| 89Cu—11Sn | 4 | 16 |
| 70Cu—30Zn | 17 | 7 |
| Al | 97 | 3 |
| Cu | 117 | 2 |
| Ag | 174 | 1 |

It has been shown that a single circuit breaker configuration can have a wide range of circuit breaker ratings by allowing the circuit current to transfer through a rating plug having specific electrical and thermal properties. To eliminate the need for trip element calibration, wherein a fixed current is applied to the circuit breaker load and line terminals 12 and 13 and the time required for the thermal element 23 to respond to articulate the operating mechanism, the rating plug of the invention is proposed for use with a shape memory element (S.M.E.) for the thermal trip element 23. The S.M.E. can comprise an alloy of Ni and Ti or a brass alloy depending upon temperature response and cost requirements. The digital response, that is, "on" or "off" positions of such a SME, wherein the element responds to a predetermined temperature, without hesitation, is ideal when used in combination with the rating plug arrangement of the instant invention. Specifically, the SME responds rapidly as soon as the set point temperature is reached. The careful selection of rating plugs to provide the SME response temperature for the various ampere ratings cooperatively provides a circuit breaker that does not need additional calibration. When a bimetal element is used for the thermal trip element 23, the bimetal element will respond to temperatures less than a predetermined temperature and thereby requires some mechanical adjustment means to set the bimetal thermal response and to ensure that the breaker will trip as soon as the predetermined temperature is exceeded. To multifunctionally provide both ampere rating and circuit breaker calibration facility to the rating plug 26 depicted in FIG. 1, the rod 28 can be threaded within the circuit breaker 10 proximate the cap 26 and the position of the conductive block 27 with respect to the heater 24 can be varied to provide the requisite bimetal calibration. The use of a variable rating plug thereby eliminates the requirement of a mechanical means for setting the bimetal spacing with respect to the heater, such as is commonly employed for bimetal calibration.

Figure 8:
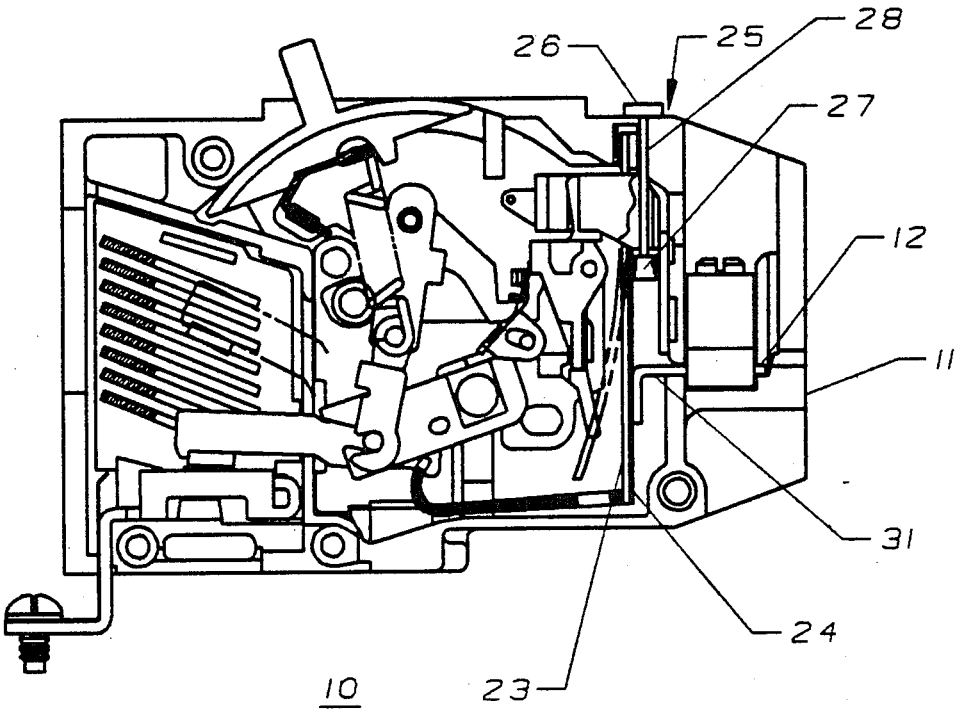
FIG. 8 is a side view of an industrial rated molded case circuit breaker using a further embodiment of the rating plug depicted in FIG. 3.

The arrangement of the rating plug 25 depicted in FIG. 8 does not depend upon the electrical transfer of circuit current through block 27 for generating heat as a circuit resistance element. The circuit current transfers directly from the load terminal strap and bridging conductor 31 to the heater 24. The function of the conductive block 27 is to provide a thermal mass for transferring the heat away from the heater. The conductive blocks 29–29E depicted in FIG. 5, which combine the selected thermal diffusivity of the metal with the selected thermal mass, efficiently carry the heat away from the heater, causing the thermal trip element to respond to higher currents, hence the higher ampere ratings.

Figure 9:
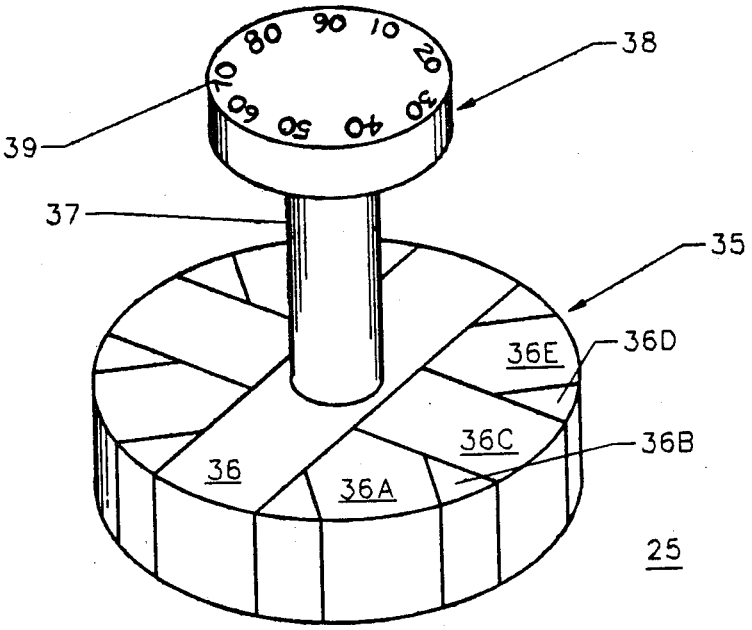
FIG. 9 is a top perspective view of an alternate rating plug used within the circuit breaker depicted in FIG. 1.

The arrangement of the rating plug 25 in FIG. 9 consists of a cylinder formed by brazing a plurality of various metal bars 36–36E, in a concentric configuration, as indicated. The cylinder is brazed to a metal shaft 37, which is attached to a rotatable cap 38. The rotation of the cap then aligns certain selected metals electrically in series between the load terminal strap 12 and the heater 24 when inserted within the circuit breaker shown in FIG. 3. Rotating the rotatable cap 38 allows for the selected metal to provide the selected ampere rating indicated at 39 on the top surface of the rotatable cap. Further adjustment thereafter allows for closer adjustment of the response of the thermal element to give extremely accurate calibration if required.

Figure 10:
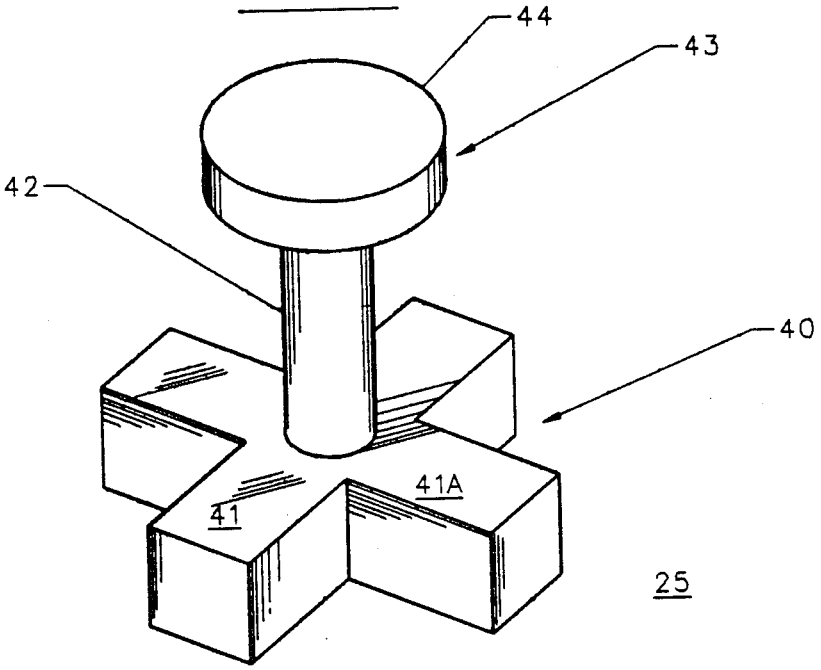
FIG. 10 is a top perspective view of an additional rating plug used within the circuit breaker depicted in FIG. 1.

A simple rating plug 25 is shown in FIG. 10 with two different metals 41, 41A arranged in a cruciform block 40 attached to a rotatable cap 43 by means of a shaft 42. The indicia 44 on the cap surface corresponds to the selected rating provided by orientation of either metal 41, 41A.

Figure 11:
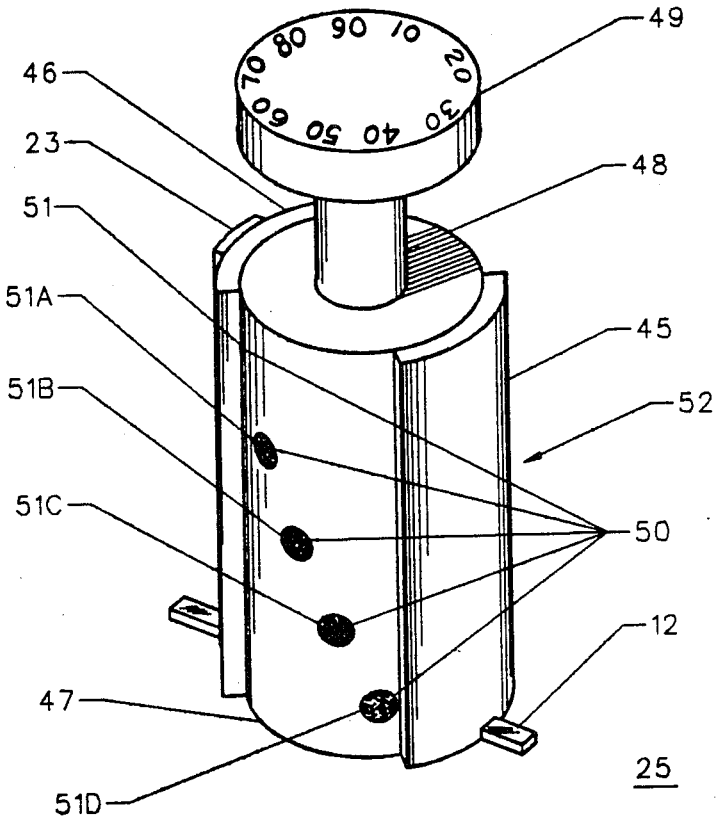
FIG. 11 is a top perspective view of a further rating plug and receptacle used within the circuit breaker depicted in FIG. 1.

An inexpensive arrangement of the rating plug 25 is shown in FIG. 11 in the form of a plastic cylindrical body 47 having a plurality of through-holes 50 for the insertion of a plurality of copper or aluminum stranded wire sections 51. The cylindrical body is closely fit within a receptacle 52 consisting of opposing curvilinear side members 45, 46. Electrical connection between the load terminal strap 12 attached to side member 45 is made through one of the selected stranded wires 51–51D to the other side member 46. The length of the heater 23 traversed by the circuit current is selected by rotating the rotatable cap 49 to align a corresponding selected wire. To promote long operation without the formation of oxides on the electrically conducting surfaces, the corresponding surfaces of the receptacle sides 45, 46 and exposed wires 51–51D can be plated with tin or silver. For high temperature stability and excellent mechanical strength, the entire rating plug including the rotatable cap 49, shaft 48 and cylindrical body 47 is formed from a unitary casting of NORYL plastic, which is a registered trademark of General Electric Company, for a high temperature thermoplastic polymer although other high temperature thermoplastics could also be employed. The stranded wires 51–51D, besides controlling the selected electrical resistance by their position along the heater, can also be selected in accordance with the metals shown in Table I to provide even higher resistance for higher rated industrial type breakers.

Having thus described our invention, what we claim as new and desire to secure by Letters Patent is:

1. A molded case electric circuit breaker having adjustable ampere rating comprising:

a plastic case and a cover;

a line terminal and a load terminal mounted on said case;

a pair of separable contacts on said case, one of which being connected with said line terminal for reciving circuit current;

an operating mechanism within said case connected with the other of said contacts for opening said contacts upon the occurrence of a predetermined circuit current through said contacts;

a thermally responsive element proximate said operating mechanism for articulating said operating mechanism when said circuit current through said contacts reaches said predetermined circuit current;

a heater element electrically in series between said contacts and arranged adjacent said thermally responsive element for providing temperature increase to said thermally responsive element in proportion to said circuit current, said heater element comprising an elongated resistive strap; and a rating plug having a defined ampere rating positioned adjacent said heater element and electrically connected in series with said heater element and said contacts for controlling the time for said thermally responsive element to reach a predetermined temperature in response to said predetermined current, said rating plug comprising a selectable electrical resistance arranged a selectable distance along said heater element.

2. The molded case electric circuit breaker of claim 1 further including receptacle means having a pair of electrically conductive members, one of said electrically conductive members being connected with said load terminal and the other of said electrically conductive members being connected with said heater element, said rating plug being inserted between both of said electrically conductive members to provide an electric current path to said heater element.

3. The molded case electric circuit breaker of claim 2 wherein said rating plug comprises a metal block having a defined length, width and height of selectable electrically conductive material said length, width and height being adjusted to provide said selectable electrical resistance.

4. The molded case electric circuit breaker of claim 2 wherein said rating plug further includes means for positioning said rating plug at said selectable distance along said heater element.

5. The molded case electric circuit breaker of claim 3 wherein said rating plug comprises a metal having a defined electrical resistivity and mass to provide said selectable electrical resistance.

6. The molded case electric circuit breaker of claim 2 wherein said rating plug is electrically connected in series with said heater element.

7. The molded case electric circuit breaker of claim 2 wherein said rating plug is electrically connected in parallel with said heater element.

8. The molded case electric circuit breaker of claim 4 wherein said rating plug positioning means comprises a cap connected to said rating plug by means of a rod having a predetermine length, said cap providing a stop on a surface of said cover when said rating plug is inserted through an opening of said cover superjacent said heater element, said rod determining said selectable distance along said heater element.

9. The molded case electric circuit breaker of claim 8 wherein said cap carries indicia on one surface visible from an exterior of said cover to identify said defined ampere rating.

10. The molded case electric circuit breaker of claim 3 wherein said metal is selected from the group cosisting of Cu, Al, Zn, Ag and Fe.

11. The molded case electric circuit breaker of claim 2 wherein said rating plug comprises a circular configuration of a plurality of metals of different electrical resistances arranged around a center point, said circular configuration being rotatable within said receptacle means for varying said selectable electrical resistance and said time for said thermally responsive element to reach said predetermined temperature.

12. The molded case electric circuit breaker of claim 2 wherein said rating plug comprises a unitary plastic construction having a cap, shank and cylindrical body member, said cylindrical body member being provided with a plurality of through-holes along a major axis.

13. The molded case electric circuit breaker of claim 12 further including a corresponding plurality of metal wires extending through said through-holes to provide selected electrical connection across said receptacle means.

14. The molded case electric circuit breaker of claim 2 wherein said rating plug comprises a cruciform configuration of a plurality of metals of varying electrical resistance and wherein said cruciform is inserted within said receptacle means for varying said selectable electrical resistance and said time for said thermally responsive element to reach said predetermined temperature.

15. The molded case electric circuit breaker of claim 1 wherein said thermally responsive element comprises a bimetal or a shaped memory element.

16. A molded case electric circuit breaker having adjustable ampere ratings comprising:

a plastic cover and a plastic case;

a line terminal and a load terminal mounted on said case;

a pair of separable contacts within said case one of which being connected with said line terminal;

an operating mechanism connected with the other of said contacts for opening said contacts upon the occurrence of a predetermined current through said contacts;

a thermally responsive element proximate said operating mechanism for articulating said operating mechanism when said current through said contacts reaches said predetermined current;

a rating plug-having a defined ampere rating proximate said thermally responsive element for controlling the time for said thermally responsive element to reach a predetermined temperature in response to said current, said rating plug comprising a metal element of selectable thermal diffusivity arranged a selectable distance along said thermally responsive element; and receptacle means comprising a pair of adjacent thermally conductive members, one of said thermally conductive memberts being arranged along said thermally responsive element, said rating plug being inserted between said thermally conductive members to provide a selectable heat sink to said thermally responsive element.

17. A molded case electric circuit breaker having adjustable ampere ratings comprising:

a plastic cover and a plastic case;

a line terminal and a load terminal mounted on said case;

a pair of separable contacts within said case one of which being connected with said line terminal;

an operating mechanism connected with the other of said contacts for opening said contacts upon the occurrence of a predetermined current through said contacts;

a thermally responsive element proximate said operating mechanism for articulating said operating mechanism when said current through said contacts reaches said predetermined current; and a rating plug having a defined ampere rating proximate said thermally responsive element for controlling the time for said thermally responsive element to reach a predetermined temperature in response to said current, said rating plug comprising a metal element of selectable thermal diffusivity arranged a selectable distance along said thermally responsive element, said rating plug being electrically connected in series with said thermally responsive element and said contacts.

18. A molded case electric circuit breaker having adjustable ampere ratings comprising:

a plastic cover and a plastic case;

a line terminal and a load terminal mounted on said case;

a pair of separable contacts within said case one of which being connected with said line terminal;

an operating mechanism connected with the other of said contacts for opening said contacts upon the occurrence of a predetermined current through said contacts;

a thermally responsive element proximate said operating mechanism for articulating said operating mechanism when said current through said contacts reaches said predetermined current; and a rating plug having a defined ampere rating proximate said theremally responsive element for controlling the time for said thermally responsive element to reach a predetermined temperature in response to said current, said rating plug comprising a metal element of selectable thermal diffusivity arranged a selectable distance along said thermally responsive element, said rating plug being electrically connected in parallel with said thermally responsive element.

19. A molded case electric circuit breaker having adjustable ampere ratings comprising:

a plastic cover and a plastic case;

a line terminal and a load terminal mounted on said case;

a pair of separable contacts within said case one of which being connected with said line terminal;

an operating mechanism connected with the other of said contacts for opening said contacts upon the occurrence of a predetermined current through said contacts;

a thermally responsive element proximate said operating mechanism for articulating said operating mechanism when said current through said contacts reaches said predetermined current; and a rating plug having a defined ampere rating proximate said thermally responsive element for controlling the time for said thermally responsive element to reach a predetermined temperature in response to said current, said rating plug comprising a metal element of selectable thermal diffusivity arranged a selectable distance along said thermally responsive element, said rating plug comprising at least two metals of different thermal diffusivities arranged in a plane, the plane of said materials being oriented with respect to said receptacle for providing said selectable thermal diffusivity to said rating plug.

20. The molded case electric circuit breaker of claim 19 wherein said metal is selected from the group of metals consisting of Cu, Al, Zn, Ag and Fe.

21. A molded case electric circuit breaker having adjustable ampere ratings comprising:

a plastic cover and a plastic case;

a line terminal and a load terminal mounted on said case;

a pair of separable contacts within said case one of which being connected with said line terminal;

an operating mechanism connected with the other of said contacts for opening said contacts upon the occurrence of a predetermined current through said contacts;

a thermally responsive element proximate said operating mechanism for articulating said operating mechanism when said current through said contacts reaches said predetermined current; and a rating plug having a defined ampere rating proximate said thermally responsive element for controlling the time for said thermally responsive element to reach a predetermined temperature in response to said current, said rating plug comprising a metal element of selectable thermal diffusivity arranged a selectable distance along said thermally responsive element, said rating plug comprising a circular configuration of a plurality of metals of different thermal diffusivities arranged around a center point, said circular configuration being rotatable within said receptacle means for varying said selectable thermal diffusivity and said time for said thermally responsive element to reach said predetermined temperature.

22. A molded case electric circuit breaker having adjustable ampere ratings comprising:

a plastic cover and a plastic case;

a line terminal and a load terminal mounted on said case;

a pair of separable contacts within said case one of which being connected with said line terminal;

an operating mechanism connected with the other of said contacts for opening said contacts upon the occurrence of a predetermined current through said contacts;

a thermally responsive element proximate said operating mechanism for articulating said operating mechanism when said current through said contacts reaches said predetermined current; and a rating plug having a defined ampere rating proximate said thermally responsive element for controlling the time for said thermally responsive element to reach a predetermined temperature in respnse to said current, said rating plug comprisin a metal element of selectable thermal diffusivity arranged a selectable distance along said thermally responsive element, said rating plug comprising a cruciform configuration of a plurality of metals of varying thermal diffusivities wherein said cruciform is inserted within said receptacle means for varying said selectable thermal diffusivity of said rating plug and said time for said thermally responsive element to reach said predetermined temperature.

* * * * *